US006095763A

United States Patent [19]

Bodzak et al.

[11] Patent Number: 6,095,763

[45] Date of Patent: Aug. 1, 2000

[54] FUEL DELIVERY PUMP WITH A BYPASS VALVE, FOR A FUEL INJECTION PUMP FOR AN INTERNAL COMBUSTION ENGINE

[75] Inventors: Stanislaw Bodzak, Elsbethen; Hanspeter Mayer, Hallein, both of Austria

[73] Assignee: Robert Bosch GmbH, Stuttgart, Germany

[21] Appl. No.: 09/029,379

[22] PCT Filed: Feb. 6, 1997

[86] PCT No.: PCT/DE97/00223

§ 371 Date: Jul. 27, 1998

§ 102(e) Date: Jul. 27, 1998

[87] PCT Pub. No.: WO97/49917

PCT Pub. Date: Dec. 31, 1997

[30] Foreign Application Priority Data

Jun. 26, 1996 [DE] Germany ..... 196 25 564

[51] Int. Cl.[7] ..... F04B 49/03; F02M 41/12

[52] U.S. Cl. ..... 417/295; 417/310; 417/440

[58] Field of Search ..... 417/295, 296, 417/310, 440, 441

[56] References Cited

U.S. PATENT DOCUMENTS

| | | | |
|---|---|---|---|
| 2,310,078 | 2/1943 | Herman | 417/295 |
| 2,481,646 | 9/1949 | Conklin | 103/120 |
| 3,146,720 | 9/1964 | Henry | 417/295 |
| 3,628,893 | 12/1971 | Carpigiani | 417/310 |
| 3,764,238 | 10/1973 | Carpigiani | 418/15 |
| 3,935,917 | 2/1976 | Eley et al. | 180/53 R |
| 4,569,202 | 2/1986 | Mouton | 60/734 |
| 4,902,202 | 2/1990 | Bowden | 417/310 |
| 5,338,161 | 8/1994 | Eley | 417/307 |
| 5,381,723 | 1/1995 | Nilsson et al. | 9/437 |
| 5,397,219 | 3/1995 | Cretors | 417/299 |
| 5,496,155 | 3/1996 | Noah et al. | 417/310 |
| 5,597,291 | 1/1997 | Bodzak et al. | 417/310 |
| 5,722,738 | 3/1998 | Beck et al. | 303/116.4 |

*Primary Examiner*—Charles G. Freay
*Assistant Examiner*—Robert Z. Evora
*Attorney, Agent, or Firm*—Ronald E. Greigg; Edwin E. Greigg

[57] ABSTRACT

A fuel delivery pump for a fuel injection pump for internal combustion engines, which includes a pair of gears that mesh with each other and are driven to rotate in a pump chamber. The gears deliver fuel from an intake chamber connected to a storage tank, along a supply conduit that is formed between the end face of the gears and the circumference wall of the pump chamber, into a pressure chamber connected to the fuel injection pump. A conduit is integrated into a housing of the fuel delivery pump and connects the intake chamber to the pressure chamber. The conduit can be opened by means of a pressure valve disposed in it, wherein the pressure valve is functionally connected to a throttle valve that throttles the fuel supply into the intake chamber as a function of the controlled pressure on the control valve via the pressure chamber.

16 Claims, 2 Drawing Sheets

FUEL DELIVERY PUMP WITH A BYPASS VALVE, FOR A FUEL INJECTION PUMP FOR AN INTERNAL COMBUSTION ENGINE

CROSS-REFERENCES TO RELATED APPLICATIONS

This application is a 371 application of PCT/DE97/00223 filed on Feb. 6, 1997.

BACKGROUND OF THE INVENTION

FIELD OF THE INVENTION

The invention is based on a fuel delivery pump for a fuel injection pump for internal combustion engines.

EP 0 166 995 B1 has disclosed a fuel delivery pump of this kind embodied as a gear delivery pump, which feeds the fuel from a storage tank into the intake chamber of a fuel injection pump. To that end, the delivery pump has a pair of gears that mesh with external engagement, which delivers fuel from an intake chamber connected to the storage tank via an intake line, into a pressure chamber connected to the intake chamber of the fuel injection pump via a supply line. To control the pressure in the pressure chamber or the feed quantity to the fuel injection pump, a bypass conduit is provided between the pressure chamber and the intake chamber of the fuel delivery pump. The opening of this bypass conduit is carried out by means of a pressure valve inserted in the bypass conduit, which valve unblocks a particular opening cross section as a function of the spring force of the valve spring when there is a particular pressure difference between the pressure chamber and the intake chamber. The opening time of the pressure valve can be set via the initial force of the valve spring, which is why the axial position of the abutment of the pressure valve spring can be adjusted.

The known fuel delivery pump, however, has the disadvantage that the bypass conduit that contains the pressure valve is disposed outside the delivery pump or spatially speaking, relatively far from the gear pair, which results in an increase in construction and assembly costs as well as taking up a lot of space.

The German Patent Application P 44 41 505.2 has disclosed a fuel delivery pump which avoids the above mentioned disadvantages. The bypass conduit that contains the pressure valve is integrated into the housing of the delivery pump so that no additional space is required. This known fuel delivery pump, though, has the disadvantage that when an engine is operating, the fuel quantity delivered is significantly higher than the fuel quantity required. The excess fuel quantity delivered is routed via the bypass valve from the pressure chamber into the intake chamber and as a result of the pressure drop thus produced at the valve, the energy is converted into heat, which produces a loss in operating power.

BRIEF SUMMARY OF THE INVENTION

The fuel delivery pump according to the invention for a fuel injection pump for internal combustion engines has the advantage over the prior art that a regulating circuit can be created in the fuel delivery pump, which is pressure and volume controlled. As a result, the power loss can be reduced by a considerable amount. By throttling fuel flow supplied to the intake chamber, when there is a sudden pressure increase due to an excess delivery quantity on the pressure side, a part of the fuel quantity delivered inside the fuel delivery pump can be prevented from being pumped around via a bypass conduit and energy can be prevented from being converted into heat due to the pressure drop at the bypass valve. By means of a flow short circuit via the bypass valve and a throttling of the fuel quantity supplied to the intake chamber, the apparatus according to the invention permits the ability to reduce pressure peaks in the pressure chamber and the supplied quantity is reduced as a result of the suction throttling.

The throttle valve, which is disposed in a housing of the fuel delivery pump and closes an inlet opening leading into the intake chamber, furthermore has the advantage that a fuel delivery pump can be embodied with a small amount of space. The throttle valve is advantageously connected to the pressure valve via a relay valve so that there can be a direct control of the throttle valve via the pressure valve. This apparatus furthermore has a component-reduced layout, by means of which an embodiment of a fuel delivery pump can be achieved which is reasonably priced and simplified in terms of assembly.

According to the invention, a multi-fuel pump, e.g. for lubrication oil, can also have the features of a delivery pump.

Other advantages and advantageous embodiments of the subject of the invention can be inferred from the description, the drawings, and the claims.

BRIEF DESCRIPTION OF THE DRAWINGS

The drawings show two exemplary embodiments of the fuel delivery pump according to the invention, which are explained in detail in the description below.

DETAILED DESCRIPTION OF THE INVENTION

Figure 1:
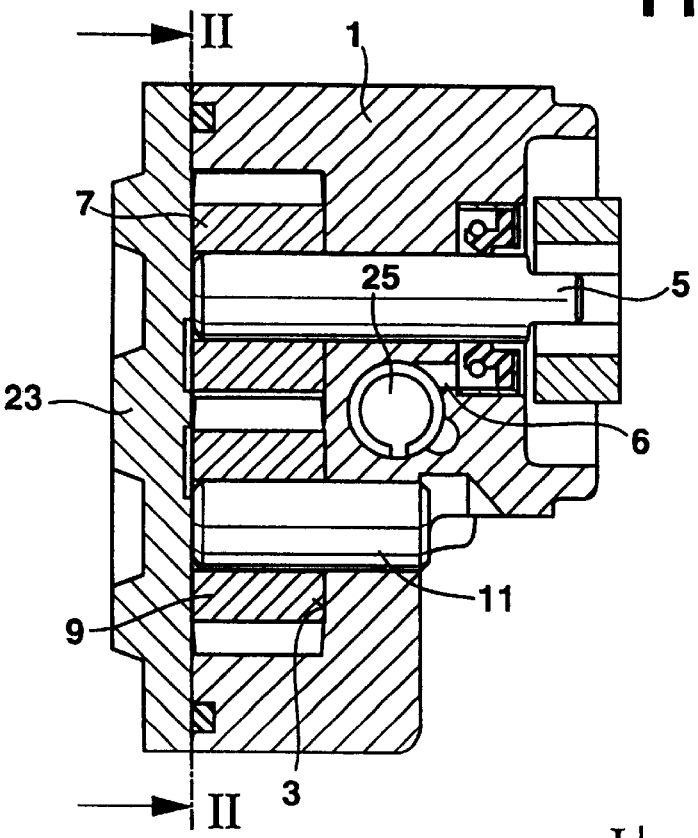
FIG. 1 is a longitudinal section through the fuel delivery pump along line I—I of FIG. 2.
Figure 2:
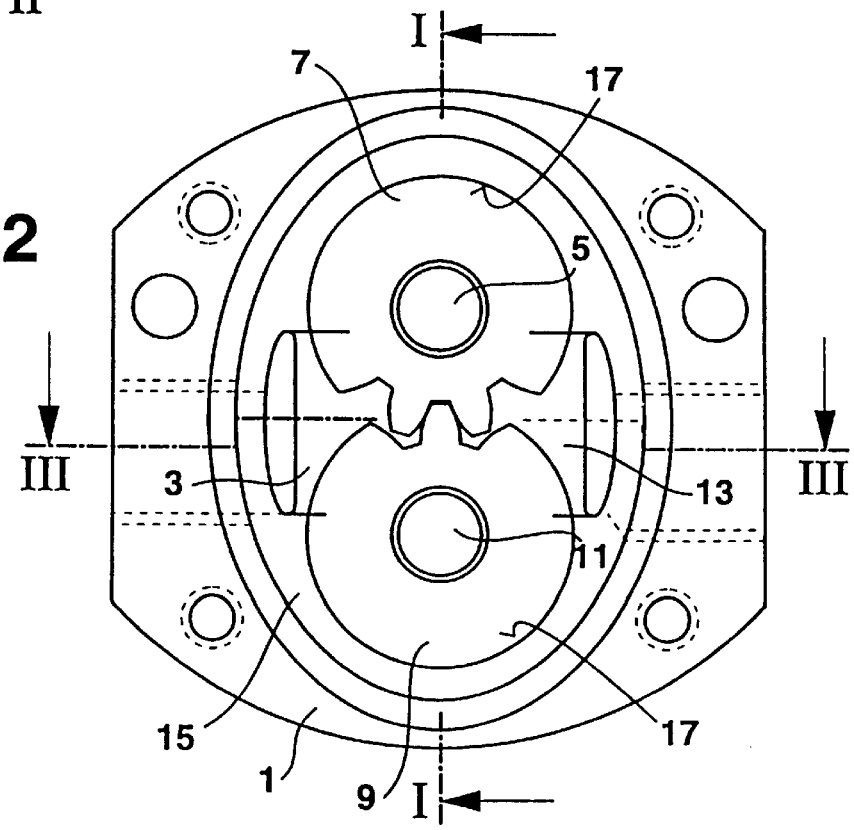
FIG. 2 is a top view of the fuel delivery pump shown in FIG. 1, with the cover taken off.
Figure 3:
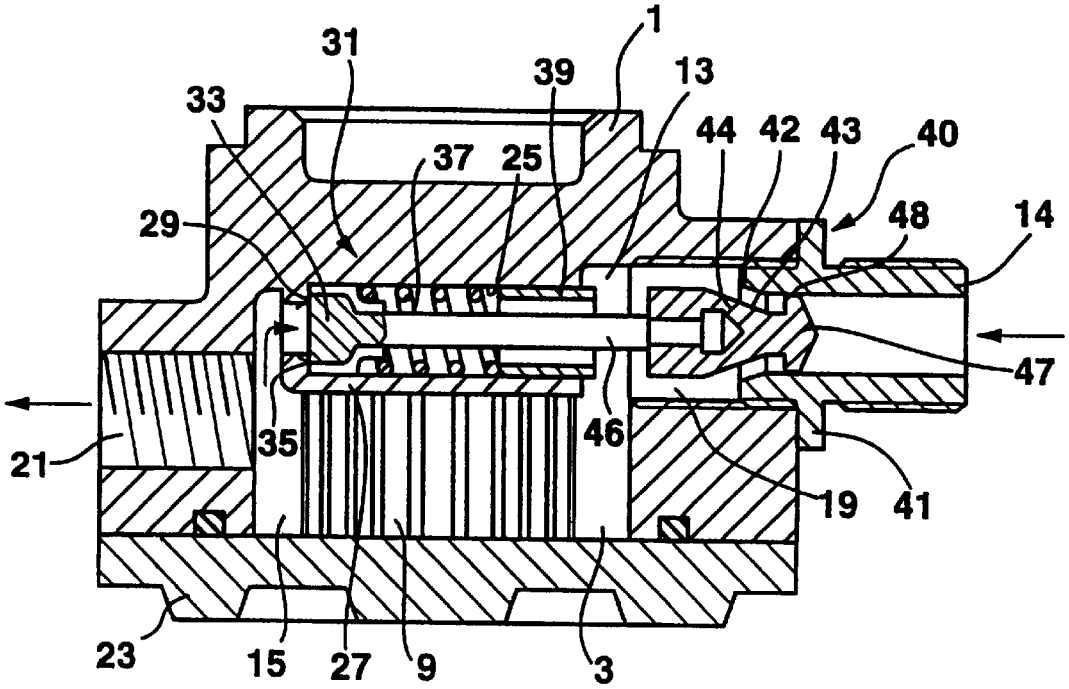
FIG. 3 is a section through FIG. 2 along the line III—III, in which the position of a conduit and the pressure valve and throttle valve disposed in it are represented.

FIGS. 1 to 3 show different views of a first embodiment of a fuel delivery pump, which is inserted in a supply line, not shown, from a storage tank to a fuel injection pump for internal combustion engines. In its housing 1, the delivery pump has a pump chamber 3 in which a rotary driven pair of gears 7, 9 that mesh with each other is disposed. A first gear 7 fastened to a first shaft 5 is driven to rotate by means of an external drive element, not shown in detail, and transmits this rotary motion by means of an end face gearing to a second gear 9 that meshes with the first gear 7 and is disposed on a second shaft 11 supported in the housing. By means of their tooth engagement, the gears 7, 9 divide the pump chamber 3 into two parts of which a first part constitutes an intake chamber 13 and a second part constitutes a pressure chamber 15. The intake chamber 13 communicates with the pressure chamber 15 via a supply conduit 17 formed between the tooth grooves on the end face of the first gear 7 and second gear 9, and the circumference of the pump edge 3. In addition, the intake chamber 13 and the pressure chamber 15 each have a connection opening 19, 21 in the wall of the pump housing 1, via which the intake chamber 13 communicates with a connecting element 14 of an intake line, not shown in detail, from the storage tank and via which the pressure chamber 15 communicates with a supply line, not shown, to the intake chamber of the fuel injection pump. The connection opening in the intake chamber 13 constitutes an inlet opening 19 and the connection opening in the pressure chamber 15 constitutes an outlet opening 21. The pump chamber 3 is sealed on its one end face in the axial direction of the shafts 5 and 11 by a housing cover 23, which has been removed in the depiction in FIG. 2 and thus permits a view of the pump interior.

Furthermore, a conduit 25 is provided in the pump housing 1 for a pressure control of the delivery pressure in the pressure chamber 15. This conduit 25 is constituted by a bore in an intermediary housing piece 27 which defines the pump chamber 3 on its end face remote from the housing cover 23, divides the pressure from the suction side, and thus constitutes a pump chamber wall. In so doing, the bore that constitutes the conduit 25 is disposed so that its cross section, projected in the axial direction, is disposed completely inside the internal cross section of the inlet opening 19. The bore that forms the conduit 25 is embodied as a through bore whose one end feeds into the pressure chamber 15 and whose other end feeds into the intake chamber 13 and constitutes a bypass conduit. On the pressure side end, the bypass conduit 25 has a cross sectional reduction in the direction of the pressure chamber 15, which reduction is constituted by a bore shoulder, wherein the annular shoulder formed on the bypass conduit end constitutes a valve seat 29 of a pressure valve 31 inserted into the conduit 25. A valve closing member 33 of the pressure valve 31 comes into contact with this valve seat 29 with a sealing face 35 formed on its pressure chamber end face as a result of the force of a valve spring 37. This valve spring 37 in the conduit 25 engages the valve closing member 33 via a shoulder and is supported on the other end against a clamping collar 39 inserted into the intake chamber end of the conduit 25. Analogous to the other components of the pressure valve 31, this clamping collar 39 can be inserted into the conduit 25 via the inlet opening 19, wherein via the axial installation depth of the clamping collar 39, which unblocks a through flow cross section, the initial force of the valve spring 37 and consequently the opening pressure of the pressure valve 31 can be set in the conduit 25, the pressure chamber 15, and the intake chamber 13. The clamping collar 39 can be press fitted into the conduit 25 or can be screwed in by means of a thread so that a very precise axial position fixing of the clamping collar 39 is possible.

A throttle valve 40 is disposed in the inlet opening 19. This throttle valve 40 has a connecting element 14 that is screwed into the inlet opening. This connecting element 14 can also be fixed in the inlet opening 19 by means of a quick acting closure or a quick acting connection. The connecting element 14 has a collar 41 which rests against the edge region of the inlet opening 19 and permits a correct positioning in the axial direction. On an intake end, the connecting element 14 has a valve seat 42, which is contacted by the sealing face 43 of a valve closing member 44 via a relay valve 46, which is connected to and of one piece with the valve closing member 33 of the pressure valve 31. Counter to the fuel delivery direction, the valve closing member 44 has a guide element 47 that is embodied as conical viewed in terms of cross section, which is connected to and of one piece with the valve closing member 44. A cylindrical section 48 of the guide element 47, which section adjoins the conical face, is embodied coaxial to the inner diameter of the connecting element 14 and is guided so that it can slide in the axial direction in relation to the connecting element 14. Viewed in terms of the flow direction, the guide element 47 has a number of recesses so that the fuel delivered can flow past the guide element 47 essentially unhampered. In an advantageous manner, four wings that are offset from each other by 90° extend to the inner wall of the connecting element 14.

The valve closing member 44 with the guide element 47 can advantageously be embodied of plastic and can be fastened to a free end of the relay valve 46 via a detent connection and/or snap connection.

Alternatively, in lieu of the conical valve seat 42, a ball-shaped valve seat can be provided. Furthermore, other geometrical shapes can be possible, which permit the line cross section leading into the intake chamber 15 to be closed.

Figure 4:
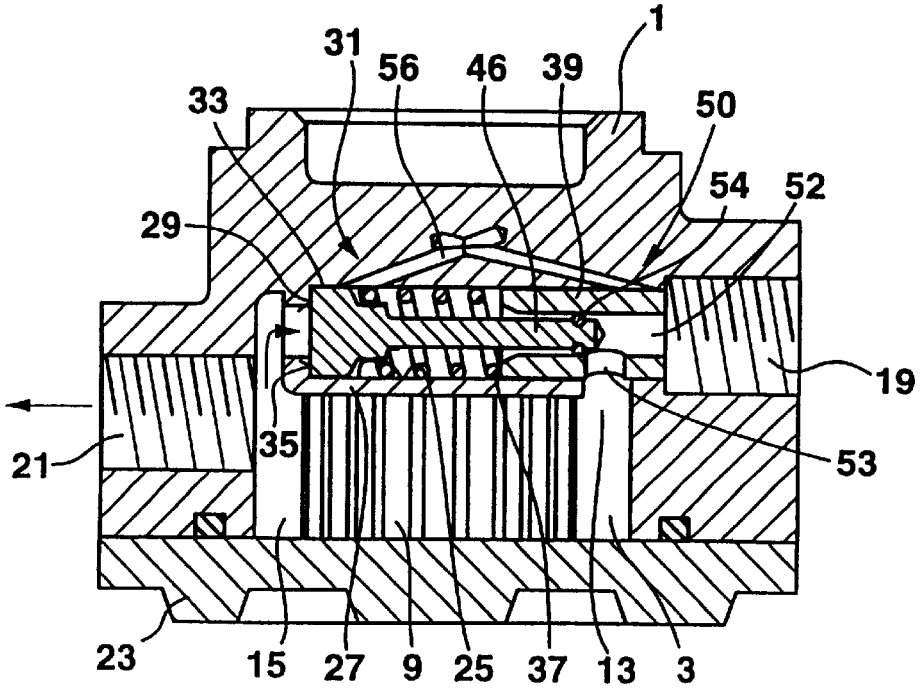
FIG. 4 shows an embodiment of the pressure valve and the throttle valve alternative to FIG. 3.

FIG. 4 shows an alternative embodiment of a throttle valve 50 in relation to the throttle valve 40 in FIG. 3. A clamping collar 39 inserted into the conduit 25 extends through the intake chamber 13 to the inlet opening 19 and has a through opening 51 which is embodied by means of a coaxial bore 52 to the inlet opening and a throttle bore 53 leading radially into the intake chamber 13. The clamping collar 39 is embodied as a throttle bush in which the relay valve 46 is guided so that it can move axially. The relay valve 46 is connected to and of one piece with the valve closing member 33 and on its opposite end, has a valve closing member 54 which is embodied by means of an O-ring, which seals the bore 52 of the clamping collar 39. The bore 52 of the clamping collar 39 is embodied as the valve seat of the throttle valve 50.

A bypass conduit 56 is provided in the housing 1 parallel to the conduit 25 immediately downstream of the valve seat 35, which bypass conduit 56 permits a return of the fuel quantity from the pressure chamber 15 into the intake chamber 13 as soon as the pressure valve:31 opens.

Both fuel delivery pumps according to the invention function according to the same principle, wherein the manner of function is explained in detail in conjunction with the exemplary embodiment represented in FIG. 4.

In the operation of internal combustion engines, the fuel injection pump and the fuel delivery pump are driven in proportion to the speed of the engine. This takes place in the fuel delivery pumps represented in FIGS. 1 to 4 by means of a mechanical transmission element, not shown, that engages the first shaft 5 from the outside. Through the rotation of the first gear 7 and the second gear 9 that meshes with it, fuel is delivered from the intake chamber 13 along the fuel conduit 17 and into the pressure chamber 15. In the course of this, a vacuum is produced in the intake chamber 13, which is sufficient to aspirate fuel from the storage tank via the intake line. The fuel pressure built up in the pressure chamber 15 produces a fuel delivery from this pressure chamber, via a supply line, and into the intake chamber of the fuel injection pump to be supplied.

When the engine is shut off, the pressure valve 31 with the functionally connected throttle valve 50 is disposed in the position shown in FIG. 4. When the pressure valve 31 is closed, the throttle valve 50 is held in an open position by means of which fuel can flow from the storage tank into the intake chamber 13. In the operation of the internal combustion engine, the pressure increases in the pressure chamber 15 due to the excess fuel delivered, by means of which the pressure valve 31 opens in opposition to the valve spring 37. At the same time, the throttle valve 50 is moved via the relay valve 46 toward the right in the direction of the inlet opening 19. When there is a slight excess pressure, the pressure valve 31 opens, by means of which there is a flow short circuit from the pressure chamber 15 to the intake chamber 13 via the bypass conduit 56. At the same time, the valve closing member 54 is moved toward the right via the relay valve 56, by means of which the cross section of the bore 53 is reduced and the suction throttle effect is intensified so that less fuel can flow into the intake chamber 13. As soon as the counterpressure in the pressure chamber 15 increases again, the valve stroke of the valve closing member 33 increases until the valve closing member 54 of the throttle valve 50 closes the bore 52 upstream of the throttle bore 53, viewed in terms of the fuel delivery direction. In this position, the valve body 33 of the pressure valve 31 completely unblocks the bypass conduit 56, by means of which there is a flow short circuit between the pressure chamber 15 and the intake chamber 13 and a fuel return is permitted from the pressure chamber 15 to the intake chamber 13. As a result, pressure peaks that build up in the pressure chamber 15 are reduced, by means of which a damping can be produced and load peaks can be prevented. Through the direction connection of the pressure valve 31 to the throttle valve 50 via the relay valve 46, a stable state can be achieved in the fuel delivery pump, by means of which a uniform delivery of the fuel quantity can be achieved which is adapted to the fuel requirement.

In contrast to FIG. 4, in the embodiment in FIG. 3, a flow short circuit is achieved by virtue of the fact that between the pressure chamber 15 and the intake chamber 13, there is a return of the fuel quantity by means of fuel flowing into the bypass conduit 25 past the valve closing member 33. The valve closing member 33 has recesses in its circumference wall so that fuel can flow into the bypass conduit 25.

As soon as the excess pressure in the pressure chamber 15 drops once more, the pressure valve 31 is moved against the valve seat 29 by the valve spring 37, by means of which the through opening 53 is at least partially or completely opened so that fuel can flow into the intake chamber 13 from the storage tank.

The foregoing relates to preferred exemplary embodiments of the invention, it being understood that other variants and embodiments thereof are possible within the spirit and scope of the invention, the latter being defined by the appended claims.

What is claimed is:

1. A fuel delivery pump for a fuel injection pump for internal combustion engines, comprising a pair of gears (7, 9), that mesh with each other and are driven to rotate in a pump chamber (3) in a housing (1), said gears (7,9) deliver fuel from an intake chamber (13) connected to a storage tank, along a supply conduit (17) that is formed between an end face of the gears (7, 9) and a circumference wall of the pump chamber (3), into a pressure chamber (15) connected to the fuel injection pump, a bypass conduit (25), which is integrated into the housing (1) of the fuel delivery pump and connects the intake chamber (13) to the pressure chamber (15), said bypass conduit is opened by means of a pressure valve (31) disposed in said bypass conduit, the pressure valve (31) is operationally connected to an axially aligned throttle valve (40, 50) that throttles the fuel delivery into the intake chamber (13) as a function of the controlled pressure on the pressure valve (31) via the pressure chamber (15).

2. The fuel delivery pump according to claim 1, in which the throttle valve (40, 50) closes an inlet opening (19) in the housing (1) that leads into the intake chamber (13).

3. The fuel delivery pump according to claim 2, in which the pressure valve (31) has a valve closing member (33) which has a sealing face (35) on a pressure chamber end, said sealing face (35) is brought into contact on said pressure chamber end with a valve seat face (29) of the conduit (25) by a valve spring (37), said valve spring is supported against a clamping collar (39) inserted into the intake chamber end of the conduit (25) and on the intake chamber end, has a relay valve (46) that contains a valve closing member (44, 54) of the throttle valve (40, 50).

4. The fuel delivery pump according to claim 1, in which the pressure valve (31) has a first valve closing member (33) which has a sealing face (35) on a pressure chamber end, said sealing face (35) is brought into contact on the pressure chamber end with a valve seat face (29) of the conduit (25) by means of a valve spring (37), said valve spring is supported against a clamping collar (39) inserted into the intake chamber end of the conduit (25) and on the intake chamber end, has a relay valve (46) that contains a second valve closing member (44) of the throttle valve (40).

5. The fuel delivery pump according to claim 4, in which the second valve closing member (44) of the throttle valve (40) has a conical jacket face (42) which is brought into contact with a valve seat (43) of a connecting element (14) that is inserted into the inlet opening (19).

6. The fuel delivery pump according to claim 5, in which the second valve closing member (44) has a guide element (47) that is guided so that the second valve closing member (44) slides in the closing direction adjacent to the conical jacket face (42).

7. The fuel delivery pump according to claim 6, in which the second valve closing member (44) can be slid onto the relay valve (46).

8. The fuel delivery pump according to claim 5, in which the second valve closing member (44) is slid onto the relay valve (46).

9. The fuel delivery pump according to claim 4, in which the throttle valve (50) has a third valve closing member (54) disposed on the relay valve (46), said third valve closing member is an O-ring.

10. The fuel delivery pump according to claim 9, in which the third valve closing member (54) is guided in said clamping collar (39) which has a through opening (52, 53) between the inlet opening (19) and the intake chamber (13), said through opening is closed by the third valve closing member (54).

11. The fuel delivery pump according to claim 10, in which the clamping collar (39) is a throttle bush in which the relay valve (46) and the third valve closing member (54) are guided so that said relay valve (46) and the third valve closing member can move axially.

12. The fuel delivery pump according to claim 11, in which second a bypass conduit (56), which connects the pressure chamber (15) to the intake chamber (13) is provided in the housing (1) parallel to the pressure valve (31) and the throttle valve (50).

13. The fuel delivery pump according to claim 10, in which a second bypass conduit (56), which connects the pressure chamber (15) to the intake chamber (13) is provided in the housing (1) parallel to the pressure valve (31) and the throttle valve (50).

14. The fuel delivery pump according to claim 9, in which the clamping collar (39) is a throttle bush in which the relay valve (46) and the third valve closing member (54) are guided so that said relay valve (46) and the third valve closing member (54) can move axially.

15. The fuel delivery pump according to claim 14, in which second a bypass conduit (56), which connects the pressure chamber (15) to the intake chamber (13) is provided in the housing (1) parallel to the pressure valve (31) and the throttle valve (50).

16. The fuel delivery pump according to claim 9, in which a second bypass conduit (56), which connects the pressure chamber (15) to the intake chamber (13) is provided in the housing (1) parallel to the throttle valve (31) and the pressure valve (50).

* * * * *